US005570617A

United States Patent [19]

Love

[11] Patent Number: 5,570,617

[45] Date of Patent: Nov. 5, 1996

[54] EXTENDIBLE EXTENSION HANDLE FOR WRENCHES, RATCHETS, TIRE IRON AND SUCH

[76] Inventor: John A. Love, 1032 Prospect Rd., Mableton, Ga. 30059

[21] Appl. No.: 493,716

[22] Filed: Jun. 22, 1995

[51] Int. Cl.[6] ..... B25G 1/04

[52] U.S. Cl. ..... 81/177.2; 16/115

[58] Field of Search ..... 81/177.1, 177.2; 16/114 R, 115

[56] References Cited

U.S. PATENT DOCUMENTS

| | | | |
|---|---|---|---|
| 2,569,069 | 9/1951 | Motel | 81/177.2 |
| 2,652,732 | 9/1953 | Kiene | 81/177.2 |
| 3,996,821 | 12/1976 | Murray | 81/177.2 |

*Primary Examiner*—James G. Smith

[57] ABSTRACT

An extendible extension handle that can be used with wrenches, ratchets, tire iron and such to permit the user to increase the leverage applied to the tool. The inner handle assembly is the base to engage the handle at one end and the tools at the opposite end. The tool end of the inner handle assembly has first and second openings in it's upper base to engage the handle portion and closed end portion of wrenches and an opening on bottom base to engage opening end wrenches. The inner handle assembly being tubular in structure allows for ratchets, tire iron and such to easily be inserted into the base. It fits around the inner handle assembly tool end and has a opening down it's shaft to engage the wrench. Once the wrench has been engage the stabilizer can be a align to a locking position which will allow the user to adjust the tension on the stabilizer clamping mechanism. The stabilizer assembly mobility is limited to a circular rotation by fixed bushings attached to the inner handle assembly. The outer handle assembly is telescoped with a L shape groove down portion of it's length and a latching mechanism for various adjustments.

2 Claims, 1 Drawing Sheet

Fig.1.
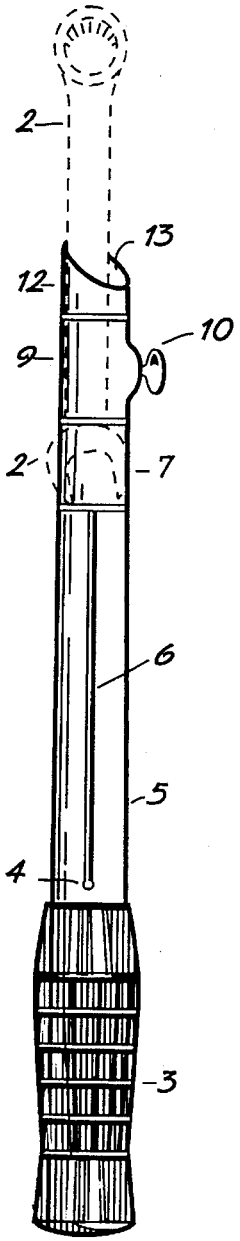
Fig.2.
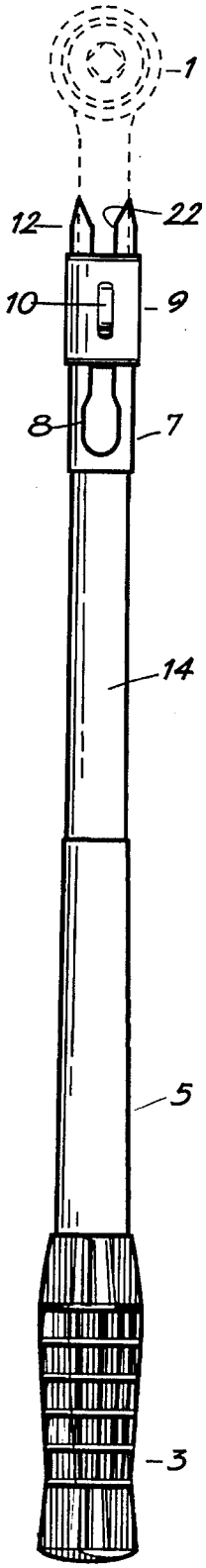
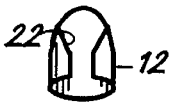
Fig.6.
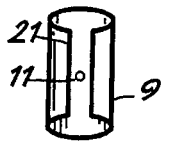
Fig.5.
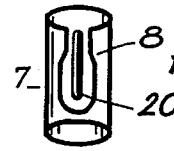
Fig.4.
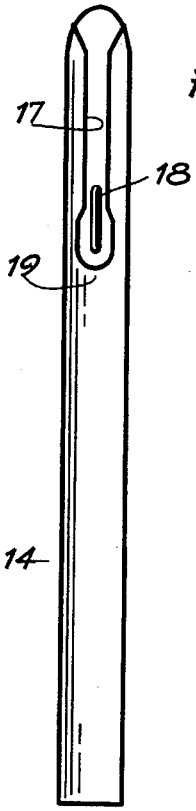
Fig.3.
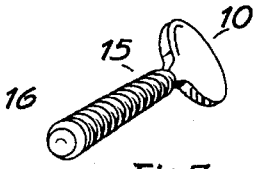
Fig.7.

EXTENDIBLE EXTENSION HANDLE FOR WRENCHES, RATCHETS, TIRE IRON AND SUCH

BACKGROUND OF THE INVENTION

For years mechanics used a long pipe around one end of a wrench to increase leverage. This would sometimes be difficult because of the size of some open end wrenches. Prior devices have been patented for increasing the mechanical advantage of user of a wrench. These devices are design having two oppositely positioned U or V shaped members near one end of the handle, for receiving the wrench. The devices referred to is described in U.S. Pat. No. 4,960,014 by Kelley 81/177.2 and U.S. Pat. No. 4,644,600 by Fugate 81/177.2.

Mechanics have also used the pipe method to increase the torque applied to a ratchet handle. The devices patented in the category EXTENDIBLE TOOL HANDLE refers to ratchets having an extendible handle to allow the user to increase the leverage and torque applied to a tool headpiece or sockets. U.S. Pat. No. 4,581,958 by Shull 81/177.2 and U.S. Pat. No. 5,285,702 by Hilliguar 81,177.2. The devices in category EXTENSION HANDLE FOR WRENCHES and EXTENDIBLE TOOL HANDLE are not design to be used universally. Often mechanics need extensions that are extendible and can be used with wrenches ratchet handles, tire irons etc.

SUMMARY OF THE INVENTION

As describe above, mechanics have for many years, used the pipe method to extend the length of a wrench and ratchet. The object of the present invention is to:

Provide an extendable extension handle with a tubular base structure designed to engage various size wrenches including open ended, closed ended and tools having handles not efficiently long enough for the amount of torque needed such as ratchets and tire irons etc.

A still further object of the present invention is to provide an improved method for securing the tool in it's base to prevent slippage when applying maximum torque.

A further object of the present invention is to provide a more stable and controllable extendible extension handle that allow the user to adjust the length for maximum leverage and torque.

The final object of the present invention is to provide an extendible extension handle that is simple, durable and comfortable to use.

BRIEF DESCRIPTION OF THE DRAWINGS

FIG. 1 is a side view of the present invention with the handle being depicted in its retracted position while in use with a open wrench.

FIG. 2 is a top view with the handle being fully extended while in use with a ratchet.

FIG. 3 is a perspective vertical view of the inner handle portion of the device.

FIG. 4 is a perspective top view of the upper fixed bushing.

FIG. 5 is a top view of the rotary portion of the stabling mechanism which secure the tool.

FIG. 6 is a perspective top view of the lower fixed bushing.

FIG. 7 is an enlarged view of the clamping mechanism which locks the tool in its base, taken from FIG. 5.

DETAIL DESCRIPTION OF THE PREFERRED EMBODIMENTS

Referring to FIG.1, which is a side view of the invention extendable extension handle for wrenches, ratchets, tire iron and such, in its retracted position while in use with a open end wrench 2, its inner surface comprises of a tabular steel structure 13, having a outer handle assembly 5 with a groove 6 down portion of its length, a commonly used latching mechanism such as that used by Jeannette U.S. Pat. No. 4,070,932, for the purpose of securing assembly 5 in its position of retraction and extension, and a handle grip 3 substantially larger than conventional ratchet handles for improve stability and control. The device can be seem from the top view while in use with a ratchet 1 in FIG. 2.

Referring to FIG. 3, which is a perspective vertical view of the inner handle assembly 14, that serves as the base to engage the outer handle assembly 5 at one end and the tools 1 and 2 at the opposite end, having first and second openings 17 and 19 in its top base with first opening 17 serving to engage the handle portion of a wrench 2 and second opening 19, being adjacent to first opening 17, with a greater width to engage the closed end positioned of wrench 2, a bottom opening 18 position opposite top second opening 19 to engage the enlarged portion of a wrench, i.e. open end head of wrench.

FIGS. 5 and 7 refer to the stabilizing assembly which secures the tools 1 and 2 once it's been engages. FIG. 5 shows a top view of the rotary shaft portion 9 of the assembly, with an opening 21 down it's shaft to allow passage of a wrench handle before being rotated into a locked position, a treaded opening 11 directly opposite to engage the clamping mechanism shown in FIG. 7. The clamping mechanism is a means of tightening and loosening comprising a bolt having a thumb grip headpiece 10, with treads 15 equal to treads 11 and a wedge 16. Limited to a circular rotation, the stabilizing assembly 9 opening 21 can be aligned with the opening 17 shown in FIG. 3 by rotating the assembly 9 clockwise to allow passage of a wrench handle, and for locking and securing the tool by rotating the assembly 9 in a counter clockwise position until the clamping mechanism is aligned with opening 17 in FIG. 3.

FIGS. 4 and 6 are perspective top view of the lower 7 and upper 12 fixed bushing before being attached to inner handle assembly 14. It can be seen that the lower fixed bushing 7 has an opening in its shaft equal to the opening 18 and 19 respectively, and the upper fixed bushing has an opening in its shaft equal to opening 17. The bushings 7 and 12 may be attached to the inner handle assembly 14 by any well known means of interconnection, such as welding or by threads. Once attached, the bushing 7 and 12 serve to limit the movement of the stabilizing assembly 9 to a circular rotation, and bushing 7 serving also to limit the outer handle assembly 5 when in a retracted position, shown in FIG. 1.

I claim:

1. An extension for standard wrenches comprising an outer handle;

an inner handle having a first slot in a first side thereof of a size to receive a standard wrench handle portion and a second slot of a larger size to receive a head of a standard wrench, a third slot is a second side of said inner handle opposite said first side of a size to receive a head of said standard wrench;

a first bushing having two slots, both of the same size as said first and second slots of said inner handle, secured to said inner handle;

a stabilizing assembly rotatably mounted on said inner handle adjacent to said first bushing and having a slot of the same size as said first slot of said inner handle, means to lock said stabilizing assembly to said handle portion of a standard wrench;

a second bushing having one slot, of the same size as said first slot of said inner handle, secured to said inner handle;

said stabilizing assembly mounted between said first and second bushing in abutting relationship to allow for rotation of said stabilizing assembly on said inner handle.

2. An extension handle of claim 1 wherein said means to lock said stabilizing assembly to said handle portion of a standard wrench is a threaded member that engages in a threaded opening in said stabilizing assembly opposite said slot of said stabilizing assembly.

* * * * *